United States Patent [19]

King

[11] Patent Number: 4,614,440

[45] Date of Patent: Sep. 30, 1986

[54] STACKED MOTIONLESS MIXER

[75] Inventor: L. Tony King, Long Beach, Calif.

[73] Assignee: Komax Systems, Inc., Long Beach, Calif.

[21] Appl. No.: 715,153

[22] Filed: Mar. 21, 1985

[51] Int. Cl.[4] ..... B01F 5/06

[52] U.S. Cl. ..... 366/336; 366/340

[58] Field of Search ..... 366/336, 337, 338, 339, 366/340; 521/917; 138/38, 42

[56] References Cited

U.S. PATENT DOCUMENTS 3,286,992 11/1966 Armeniades ..... 366/339
3,860,217 1/1975 Grout ..... 366/336
3,923,288 12/1975 King ..... 366/336
4,208,136 6/1980 King ..... 366/338
4,522,504 6/1985 Greverath ..... 366/339

*Primary Examiner*—Robert W. Jenkins
*Attorney, Agent, or Firm*—Malcolm B. Wittenberg

[57] ABSTRACT

A stationary material mixing apparatus for mixing various components in a fluid stream. The mixing apparatus is in the shape of a conduit which is made up of individual biscuit sections which are aligned along a longitudinal axis, the biscuit sections each containing a plurality of openings therethrough where within openings are located mixing elements which induce a rotational angular velocity to the fluid stream.

13 Claims, 4 Drawing Figures

STACKED MOTIONLESS MIXER

DESCRIPTION

1. Technical Field

The present invention deals with a material mixing apparatus which contains various elements traditionally known as static mixers for mixing various components of a fluid stream. In judiciously arranging the various static mixing elements pursuant to the present invention, enhanced mixing can be achieved over comparable devices of the prior art.

2. Background of the Invention

It has long been realized that static mixers if made to work efficiently, provide certain economic advantageous over dynamic mixers for, as the name implies, static mixers employ no moving parts. As such, static devices are generally less expensive to configure and certainly much less expensive to maintain while providing the user with an extended useful life for the mixer product in service.

Prior art approaches to static mixers have generally involved expensive machining, molding, casting or other fabrication of the component mixer elements coupled with some type of permanent attachment between elements and a conduit and/or between elements within a conduit. The resulting cost and difficulty of manufacture results in a relatively expensive end product. Moreover, many of the prior mixers provide less than complete mixing particularly with respect to material flowing along the walls of the conduit. This so called "wall-smearing" is related to the parabolic velocity profile of a fluid having laminar flow in a pipe where the fluid velocity is small or zero along the wall surfaces.

A marked improvement in static mixer technology was represented by the teachings of applicant's prior U.S. Pat. No. 3,923,288. The invention embodied in the cited patent was taught to be a stationary material mixing apparatus comprised of a plurality of self-nesting, abutting and axially overlapping elements which are fit into a conduit. Each region of axial overlap between elements provides a mixing matrix introducing complex velocity vectors into the materials.

In the case of a single imput stream into an assembly of "n" mixing elements such as those disclosed in U.S. Pat. No. 3,923,288, one obtains $2^n$ divisions of the stream. This is so because each mixing element involves a $2\times2$ division of the flow stream.

It is an object of the present invention to increase the mixing efficiency of mixing elements such as those disclosed in the cited prior art to something greater than $2^n$ divisions which is commonly experienced. Preferably the mixing efficiency enhancement can be achieved without undo cost in the fabrication of the motionless mixer itself as well as without experiencing excessive pressure drops across the device.

This and other objects will be made further apparent when considering the following disclosure and appended drawings wherein.

SUMMARY OF INVENTION

In its broadest terms, the device of the present invention comprises a stationary material mixing apparatus for mixing a fluid stream which is in the shape of conduit comprising individual biscuit sections. The sections are aligned along a common longitudinal axis while each biscuit section comprises a plurality of openings therethrough where within said openings are located mixing elements which induce a rotational angular velocity to the fluid stream. The device is further characterized such that substantially all of the mixing elements induce the same rotational sign to the fluid. Lastly, it is preferable to misalign openings in adjacent biscuit sections.

DETAILED DESCRIPTION OF THE INVENTION

Figure 1:
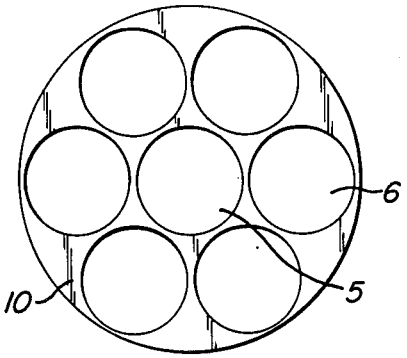
FIG. 1 is a plan view of one biscuit section of the mixing apparatus without mixing elements located therein.

Referring to FIG. 1, element 10 represents a typical biscuit section in plan view having central opening 5 and peripheral openings 6. It must be emphasized that this particular hexagonal hole configuration with center hole 5 is used for illustrative purposes only and its depiction in no way is intended to limit the present invention to such a pattern. In fact, the hole pattern can be of almost any appearance to the point where the various openings need not even be of a constant or uniform size.

Virtually any mixing element can be placed within openings 5, 6, etc. which in part induce a rotational velocity to the fluid passing therethrough. Typical of such elements are those disclosed in U.S. Pat. No. 3,923,288, the disclosure of which is incorporated herein by reference. Such elements are depicted by numeral 13 of FIGS. 3 and 4 and, in practicing the present invention it is intended that each of the mixing elements induce or impart the same rotational sign to the fluid passing through the biscuit openings.

Figure 2:
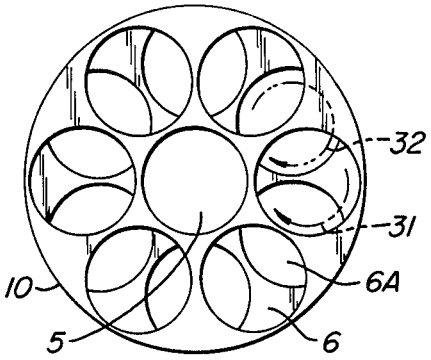
FIG. 2 represents two biscuit elements, one in plan view and one in phantom view showing the prefered nesting relationship between adjacent elements, again, without mixing elements located therein.

The sign of rotation of the mixed fluid is shown schematically by elements 31 and 32 of FIG. 2. As previously indicated, it is the intent of the present invention to provide a number of longitudinally aligned biscuit elements such as shown as elements 10, 11, etc. of FIG. 3 and to provide for openings in adjacent biscuit elements to be misaligned. The misalignment is typified by the plan view of FIG. 2 whereby the geometric center of hole 6 coincides with the periphery of hole 6A, the latter opening appearing in adjacent biscuit element 11. This misalignment is the result of approximately 30° shift between adjacent biscuits.

In considering the present invention, it was recognized that unless adjacent biscuit elements were misaligned, a fluid injected into an upstream cell or opening such as opening 6 of FIG. 1 would tend to channel its way through the various downstream biscuit elements and although the fluid stream would be somewhat mixed, intercell mixing would not occur. By misaligning biscuit elements such as shown in FIG. 2 each cell of, for example, biscuit 11 would accept or capture material from 2 cells of biscuit 10 and, as such, mixing would be enhanced.

Figure 4:
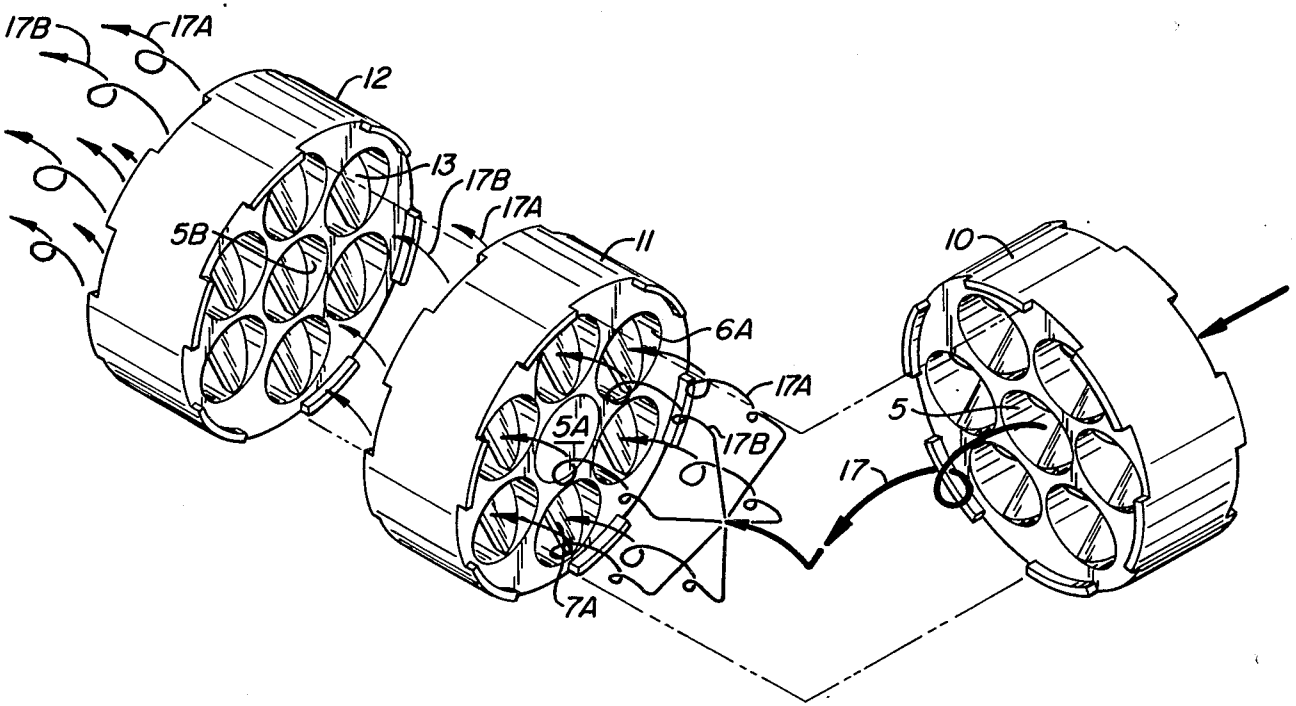
FIG. 4 depicts three biscuit sections in exploded view as being illustrative of the fluid flow through the device of the present invention.

As a further means of enhancing the mixing phenomeonon, it has been found preferable to block openings in various biscuit sections. Ideally, the blocked openings would be located in alternate biscuits, that is, not in adjacent biscuits and, most preferably, blocked openings would be located in the geometric centers of the various biscuits. FIG. 4 is illustrative of this embodiment wherein biscuits 10, 11, and 12 are shown in an exploded perspective view whereby fluid stream 17 is shown emanating from center hole 5 of biscuit element 10. Without the blockage of center hole 5A biscuit of 11, the fluid traveling along path 17 would tend to burrow through all of the longitudinally aligned center openings 5, 5A and 5B without any adjacent hole mixing. By blocking center hole 5A, fluid stream traveling through center opening 5 is caused to proceed through opening 6A and 7A etc. of biscuit 11 and assume paths 17A, 17B etc. prior to encountering biscuit 12. At biscuit 12, fluid stream 17A and 17B can be broken up even further for now center hole 5B is in an unpluged condition and will accept fluid as will adjacent mixing openings.

Although a prefered embodiment in practicing the present invention is shown in FIG. 4 wherein alternate biscuit elements contain blocked or plugged centrally located ports, the present invention can be practiced without blocking any mixing openings or by blocking some centrally located openings without adhering to a specific alternate biscuit pattern. Clearly, however, the blockage of alternative biscuit center openings is prefered for it causes the traveling fluid to assume a most circuitous path and thus encounter a maximum number of mixing elements.

Figure 3:
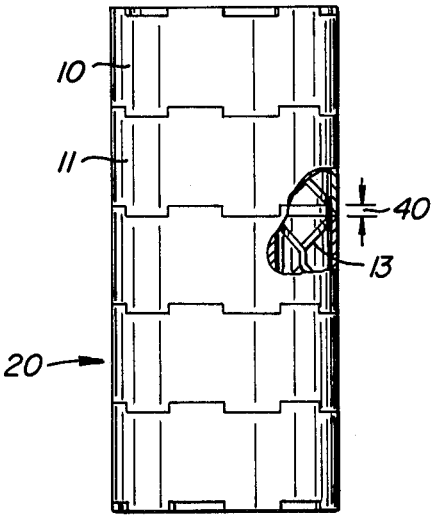
FIG. 3 represents a partially cut-away side view of the present mixing apparatus showing various biscuit sections nested pursuant to the present invention.

When one or more center openings in the system are blocked, it is prefered to space biscuit elements from one another to enable fluid downstream from a biscuit containing a blocked opening to encounter an unblocked centrally located opening therein FIG. 3 is referred to as being illustrative of the present invention whereby biscuits 10, 11, etc. making up conduit 20 are notched to provide a nesting or interlocking relationship. Further, internal spacing 40 is provided to enable proper fluid handing in and around biscuits containing centrally blocked openings which further reduces the pressure drop along the overall conduit. Although the specific spacing 40 is a matter of design choice, it has been found that when using fluids of a viscosity of approximately 1000 cps traveling through 2 inch diameter biscuits such as shown in FIG. 4 in which adjacent biscuits possess center openings which have been plugged or blocked, that a spacing of approximately 0.1 of the biscuit O.D. or about 0.25 of the element hole size between adjacent biscuits satisfactorily reduces the pressure drop across the conduit and provides for an ideal mixing environment.

As previously noted, in the case of a single input stream into an assembly of "n" mixing elements such as those shown in U.S. Pat. No. 3,923,288, one would obtain $2^n$ divisions of the input stream. However, in practicing the present invention, a 2 inch mixer would behave like a $2^{2n}$ mixer. To further the illustration, if one were to provide 6 peripheral holes in an 8 biscuit conduit, instead of having $6\times2^n$ which equals $6\times2^8$ or $6\times256$, one would have $6\times2^{2n}$ or $6\times2^{16}$ which equals $6\times65536$. The improvement factor thus achieved in practicing the present invention is represented by the fraction 65536/256 or 256.

In view of the foregoing, modifications to the disclosed embodiments can be made while remaining within the spirit of the invention by those of ordinary skill in the art. For example, the various openings, 5,6, etc. can clearly be made of a shape other than circular. As such, the scope of the invention is to be limited only by the appended claims.

I claim:

1. A stationary material mixing apparatus for mixing a fluid stream which is in the shape of a conduit compromising individual biscuit sections which are aligned along a longitudinal axis, said biscuit sections each possessing a plurality of openings where within said openings are located mixing elements which induce a rotational angular velocity to the fluid stream passing therethrough, said apparatus being further characterized such that substantially all of said mixing elements induce the same rotational sign to said fluid and wherein at least some of said openings in any one biscuit are misaligned with respect to openings in adjacent biscuit elements and at least one of said openings in one or more of said biscuits is blocked to the flow of said fluid stream.

2. The apparatus of claim 1 wherein spacing is created between individual biscuit elements to substantially reduce the pressure gradient through the conduit.

3. The apparatus of claim 1 wherein said blocked openings are located proximate the geometric centers of said biscuits.

4. The apparatus of claim 3 wherein said blocked openings are located in alternate biscuits along said longitudinal axis.

5. The apparatus of claim 1 wherein the biscuits possess side walls which are notched so that adjacent biscuits are nested and interlocking.

6. The apparatus of claim 1 wherein said openings are substantially circular in cross-section.

7. The apparatus of claim 1 wherein said biscuit misalignment is such that the geometric centers of at least some of the openings of one biscuit substantially coincide with the periphery of at least some of the openings of adjacent biscuits.

8. A stationary material mixing apparatus for mixing a fluid stream which is in the shape of a conduit comprising individual biscuit sections which are aligned along a longitudinal axis, said biscuit sections each compromising an opening located at the geometric center of said biscuit sections and two or more additional openings located adjacent said centrally located opening and wherein in at least some of the biscuit sections, the centrally located opening has been blocked and wherein in unblocked openings of each biscuit are placed mixing elements which induce a rotational angular velocity to the fluid stream passing therethrough, said apparatus being further characterized such that substantially all of said mixing elements induce the same rotational sign to said fluid passing therethrough and wherein said openings in any one biscuit which are located adjacent to said centrally located opening are misaligned with respect to openings in adjacent biscuit elements.

9. The apparatus of claim 8 wherein spacing is created between individual biscuit elements to substantially reduce the pressure gradient through the conduit.

10. The apparatus of claim 8 wherein said blocked openings are located in alternate biscuits along said longitudinal axis.

11. The apparatus of claim 8 wherein said openings are substantially circular in cross-section.

12. The apparatus of claim 11 wherein six openings are located in each biscuit evenly spaced about said centrally located opening.

13. The apparatus of claim 12 wherein each biscuit is turned approximately 30° about the longitudinal axis to effect said misalignment.

* * * * *